US009364943B2

(12) United States Patent
Chang

(10) Patent No.: US 9,364,943 B2
(45) Date of Patent: Jun. 14, 2016

(54) QUICK ROTATABLE WRENCH

(71) Applicant: Chih-Min Chang, Changhua County (TW)

(72) Inventor: Chih-Min Chang, Changhua County (TW)

( * ) Notice: Subject to any disclaimer, the term of this patent is extended or adjusted under 35 U.S.C. 154(b) by 191 days.

(21) Appl. No.: 14/102,299

(22) Filed: Dec. 10, 2013

(65) Prior Publication Data

US 2015/0158156 A1 Jun. 11, 2015

(51) Int. Cl.

| | |
|---|---|
| ***B25B 23/00*** | (2006.01) |
| ***B25B 13/46*** | (2006.01) |
| ***B25G 1/06*** | (2006.01) |

(52) U.S. Cl.

CPC ..... *B25B 23/0028* (2013.01); *B25B 13/463* (2013.01); *B25G 1/063* (2013.01)

(58) Field of Classification Search

CPC ..... B25G 1/063; B25B 13/46; B25B 13/461; B25B 13/463; B25B 13/466; B25B 23/0007; B25B 23/0028

USPC ..... 81/177.7, 177.75, 177.8, 177.9

See application file for complete search history.

(56) References Cited

U.S. PATENT DOCUMENTS

| | | | | |
|---|---|---|---|---|
| 2,921,773 | A * | 1/1960 | Hoelzer | B65G 7/12 254/129 |
| 6,928,904 | B2 * | 8/2005 | Hsien | B25G 1/063 81/177.8 |
| 7,373,861 | B2 * | 5/2008 | Hsieh | B25G 1/063 403/93 |
| 8,215,208 | B2 * | 7/2012 | Blackston | B25B 13/481 81/177.75 |
| 2007/0144313 | A1 * | 6/2007 | Chang | B25B 13/481 81/177.75 |

* cited by examiner

*Primary Examiner* — Hadi Shakeri

(74) *Attorney, Agent, or Firm* — Muncy, Geissler, Olds & Lowe, P.C.

(57) ABSTRACT

A quick rotatable wrench includes a first bar including a first position limit portion and a rotary connector, a second bar including a second position limit portion having a shape complementary to the first position limit portion and a recessed accommodation chamber, and a position limit device to secure the rotary connector to the inside of the recessed accommodation chamber in such a manner that the first bar is movable relative to the second bar between an engaged position where the first and second position limit portions are engaged together to secure the first bar and the second bar together and a released position where the first and second position limit portions are disengaged from each other and the rotary connector is rotatable in the recessed accommodation chamber for allowing relative rotation between the first bar and the second bar.

6 Claims, 5 Drawing Sheets

QUICK ROTATABLE WRENCH

BACKGROUND OF THE INVENTION

1. Field of the Invention

The present invention relates to wrench technology, and more particularly to a quick rotatable wrench.

2. Description of the Related Art

Referring to FIG. 1, a conventional quick rotatable wrench 10 is known comprising a long bar 11, a short bar 12 mounted at one end of the long bar 11, a ratchet wheel (not shown) mounted within the short bar 12, a socket 14, and an adapter 13 coupled between the ratchet wheel in the short bar 12 and the socket 14 for enabling the socket 14 to be synchronously rotated with the ratchet wheel to rotate a nut.

Further, a switching mechanism (not shown) is mounted between the long bar 11 and the short bar 12 and switchable by a switch button 16 between a locking position where the long bar 11 and the short bar 12 are locked together and an unlocking position where the long bar 11 and the short bar 12 are pivotable relative to each other. When the long bar 11 and the short bar 12 are locked together, the wrench 10 is operable to fasten up or loosen a nut. On the contrary, when the long bar 11 and the short bar 12 are pivotable relative to each other, the user can move the long bar 11 to rotate the short bar 12 through 360° without rotating the whole wrench 10 through 360°. Under this condition, the wrench 10 generates less torque, however, the short bar 12 can be rotated to fasten up or loosen a nut rapidly.

However, because the switching mechanism of the quick rotatable wrench 10 has a complicated structure, it is hard to make and assemble this design of switching mechanism. Further, the user needs to frequently switch the wrench 10 between the aforesaid two status (to lock the long bar 11 and the short bar 12, or to allow relative rotation between the long bar 11 and the short bar 12) during working, however, because the switch button 16 is located at one end of the long bar 11 far from the user's hand grip position, the user cannot smoothly and quickly operate the switch button 16 to perform the aforesaid switching action.

SUMMARY OF THE INVENTION

The present invention has been accomplished under the circumstances in view. It is the main object of the present invention to provide a quick rotatable wrench, which has a simple structure, and allows the user to smoothly and rapidly switch its quick rotation function.

To achieve this and other objects of the present invention, a quick rotatable wrench of the invention comprises a first bar, a second bar, and a position limit device. The first bar comprises a first surface, a first position limit portion located at the first surface, and a rotary connector extended from the first position limit portion. The second bar comprises a second surface, a second position limit portion located at the second surface in a complementary shape to fit the first position limit portion, and a recessed accommodation chamber formed in the second position limit portion and adapted to accommodate the rotary connector. The first bar is movable relative to the second bar between an engaged (locking) position where the first position limit portion and the second position limit portion are engaged together to lock the first bar and the second bar together, and a released (unlocking) position where the first position limit portion and the second position limit portion are disengaged from each other and the rotary connector is rotatable in the recessed accommodation chamber for allowing the first bar and the second bar to be moved relative to each other. The position limit device is mounted at the second bar to secure the rotary connector of the first bar to the inside of the recessed accommodation chamber of the second bar.

The first bar works as a handle for holding by the user using the wrench, and the second bar is adapted for turning bolts and nuts. Alternatively, the functioning of first bar and the second bar can be exchanged. Further, the user can directly apply a force to the holding part of the wrench to move the first bar relative to the second bar to the engaged (locking) position for turning a bolt or nut, or to move the first bar relative to the second bar to the released (unlocking) position for rapidly fastening up a bolt or nut, or dismounting a loosened bolt or nut.

Thus, the quick rotatable wrench allows the user to smoothly and rapidly switch the quick rotation function. Further, this design of quick rotatable wrench has a simple structure, therefore it is easy to make and to assemble.

Other advantages and features of the present invention will be fully understood by reference to the following specification in conjunction with the accompanying drawings, in which like reference signs denote like components of structure.

DETAILED DESCRIPTION OF THE INVENTION

Figure 1:
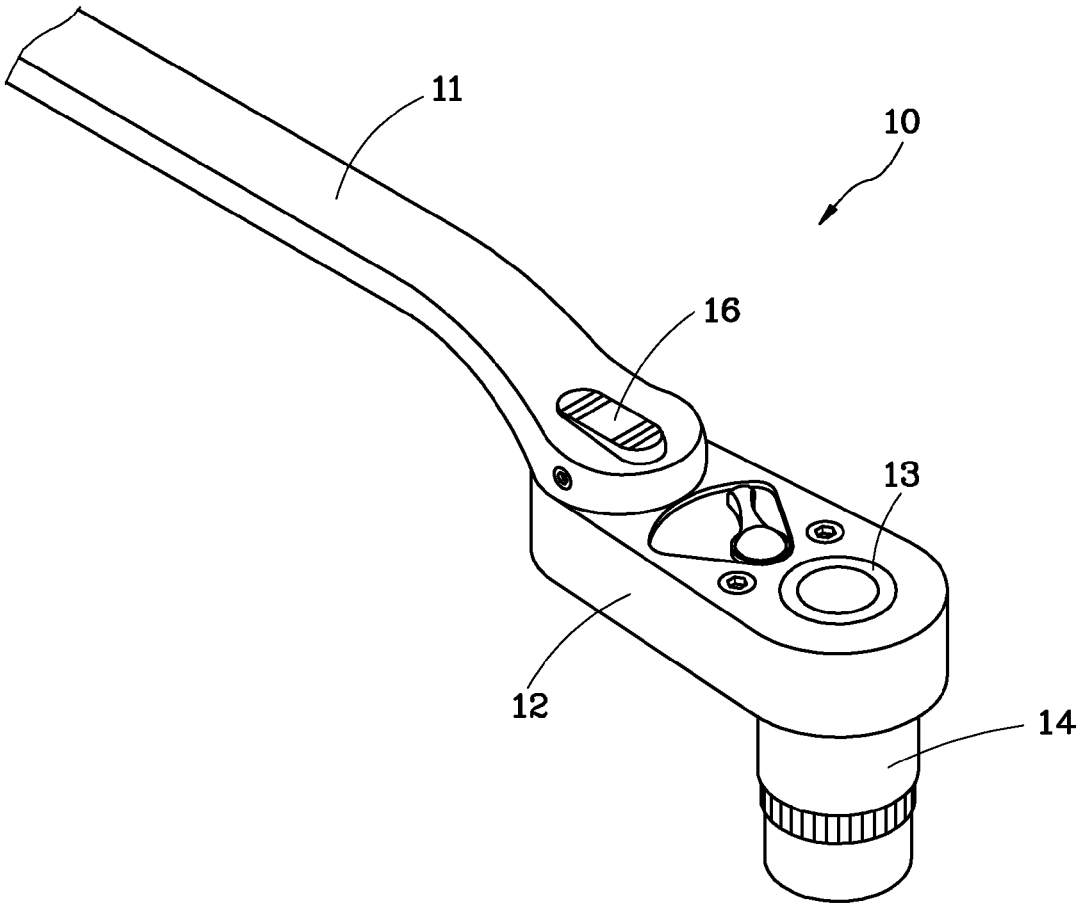
FIG. 1 PRIOR ART
FIG. 1 is an oblique top elevational view of a quick rotatable wrench according to the prior art.
Figure 2:
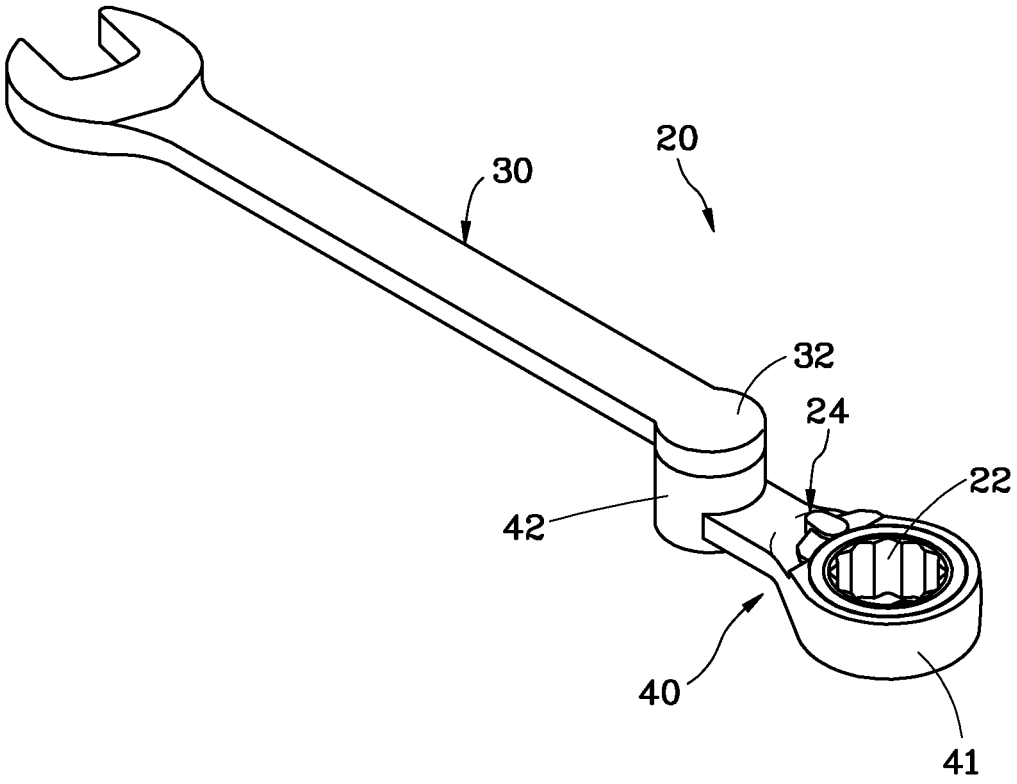
FIG. 2 is an oblique top elevational view of a quick rotatable wrench in accordance with the present invention.
Figure 3:
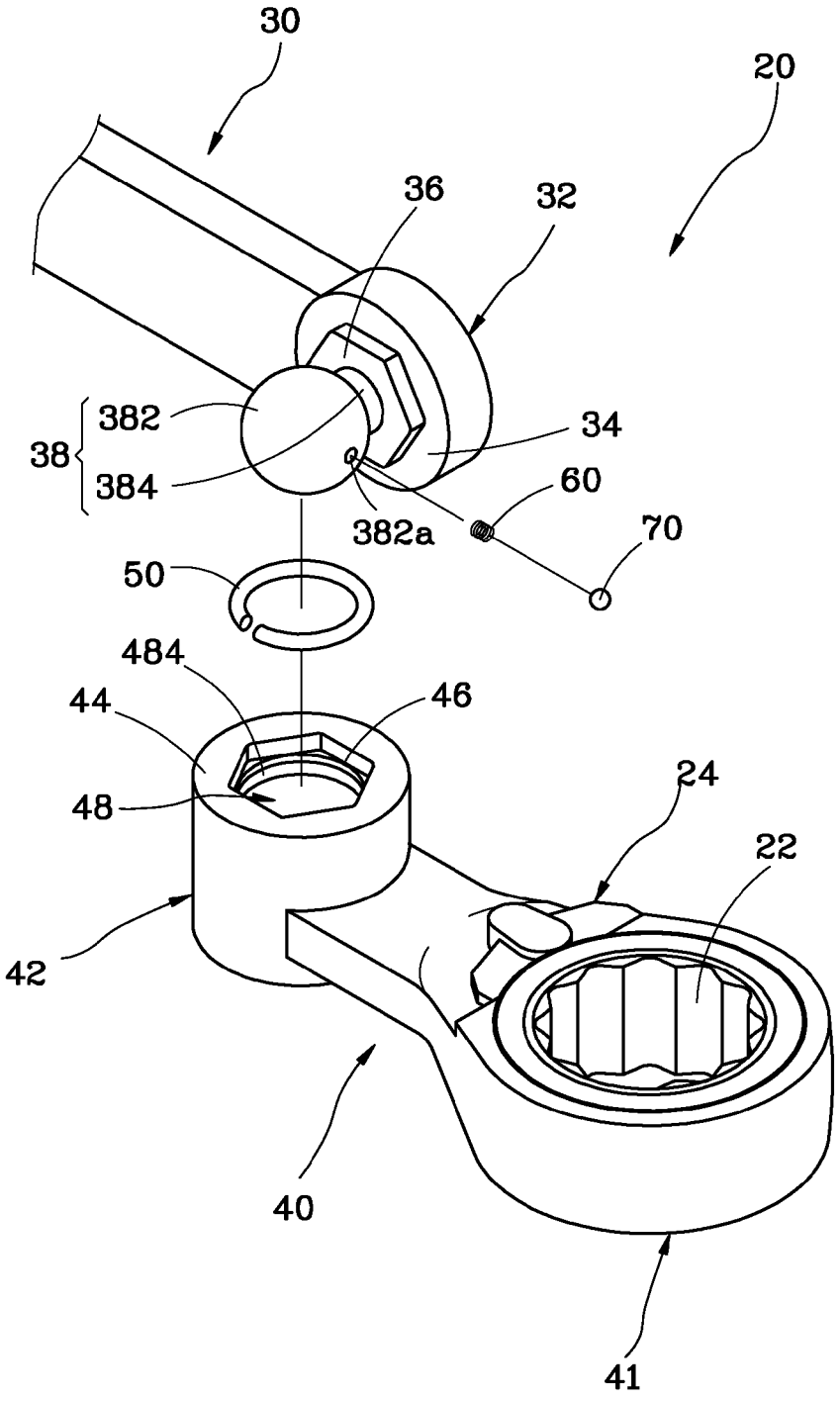
FIG. 3 is an exploded view of the quick rotatable wrench in accordance with the present invention.

Referring to FIGS. 2 and 3, a quick rotatable wrench in accordance with the present invention is shown. As illustrated, the quick rotatable wrench 20 comprises a ratchet wheel 22, a brake device 24, a first bar 30, a second bar 40, a position limit device 50, an elastic member 60, and a rolling ball 70.

The ratchet wheel 22 and the brake device 24 are mounted in a working end portion 41 at one end of the second bar 40. The shapes and structures of the working end portion 41, ratchet wheel 22 and brake device 24 are same as the prior art design, and therefore no further detailed description in this regard will be given. Further, the working end portion 41 and the loaded ratchet wheel 22 and brake device 24 are not limited to the illustrated configurations. They can be configured to fit a socket wrench like the prior art design. Alternatively, they can be configured to fit a simple box wrench.

The main feature of the present invention is that the first bar 30 comprises a connection end portion 32 located at its one end; the second bar 40 further comprises a connection end portion 42 located at an opposite end thereof remote from working end portion 41 and connected to the connection end portion 32 of the first bar 30.

The first bar 30 comprises a first surface 34 located at the connection end portion 32, a first position limit portion 36 located at the first surface 34, and a rotary connector 38 extended from the first position limit portion 36. In this embodiment, the first position limit portion 36 is a block member raised from the first surface 34, and the outer contour of the first position limit portion 36 is a regular hexagon; the rotary connector 38 comprises a spherical head 382, a neck 384 connected between the spherical head 382 and the first position limit portion 36, and a recessed hole 382*a* formed in the spherical head 382.

Figure 4:
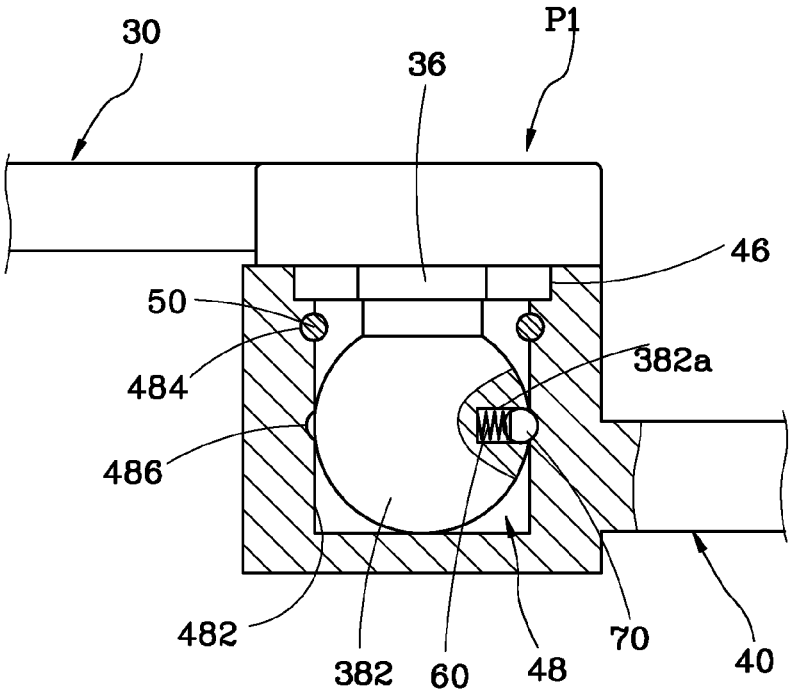
FIG. 4 is a sectional view of the present invention, illustrating the first bar of the quick rotatable wrench in the engaged (locking) position.
Figure 5:
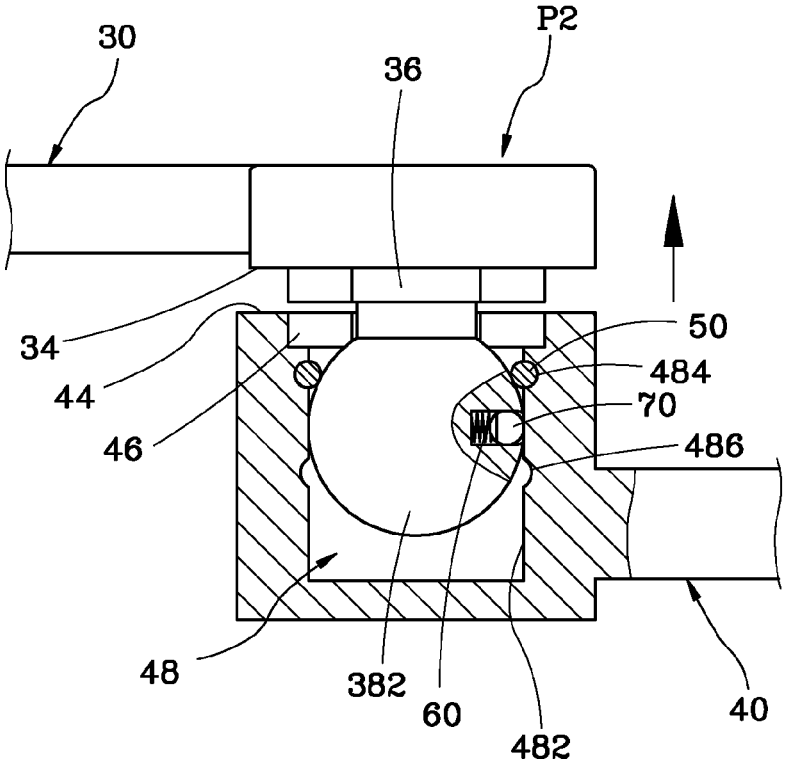
FIG. 5 is similar to FIG. 4, illustrating the first bar of the quick rotatable wrench in the released (unlocking) position.

The second bar 40 further comprises a second surface 44 located at the connection end portion 42, a second position limit portion 46 located at the second surface 44 and having a complementary shape to fit the first position limit portion 36, and a recessed accommodation chamber 48 formed in the second position limit portion 46. In this embodiment, the second position limit portion 46 is a recessed hole formed in the second surface 44, and the inner contour of the second position limit portion 46 is a regular hexagon; the recessed accommodation chamber 48 is a circular blind hole formed in the recessed hole (second position limit portion 46), as shown in FIGS. 4 and 5, defining a mounting groove 484 in an inner wall 482 thereof at a location adjacent to the second position limit portion 46 and a retaining groove 486 in the inner wall 482 at a location far from the second position limit portion 46. Further, the mounting groove 484 and the retaining groove 486 are annular grooves.

The position limit device 50 is a C-shaped retaining ring mounted in the mounting groove 484 of the second bar 40 to secure the spherical head 382 of the first bar 30 to the inside of the recessed accommodation chamber 48 of the second bar 40. Thus, the inner wall 482 and retaining groove 486 of the recessed accommodation chamber 48 surround the spherical head 382.

The elastic member 60 and the rolling ball 70 are mounted in the recessed hole 382*a* at the spherical head 382 of the first bar 30 in such a manner that the elastic member 60 is stopped against the spherical head 382, and the rolling ball 70 is supported between the elastic member 60 and the inner wall 482 (see FIG. 5) or retaining groove 486 (see FIG. 4) of the recessed accommodation chamber 48 of the second bar 40.

Figure 6:
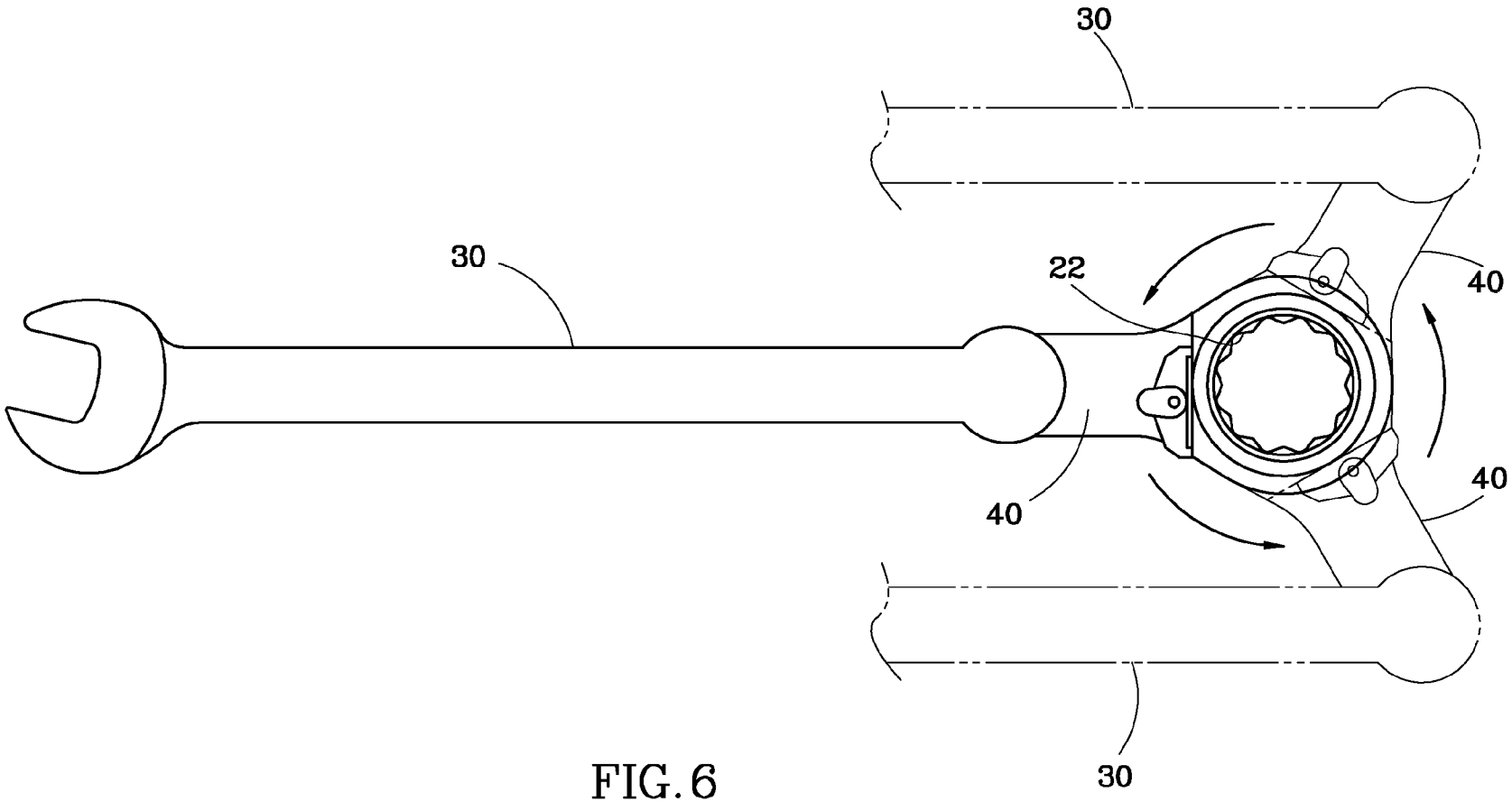
FIG. 6 is a schematic top view of the present invention, illustrating the performance of the quick rotation function of the quick rotatable wrench.

More specifically, the first bar 30 is movable relative to the second bar 40 between an engaged (locking) position P1 (see FIG. 4) and a released (unlocking) position P2 (see FIG. 5). When the first bar 30 is in the engaged position P1, the two position limit portions 36;46 are engaged together, causing the two bars 30;40 to be secured to each other. At this time, the wrench 20 can be used to fasten up or loosen nuts and bolts by means of the ratchet wheel 22. Further, the rolling ball 70 is stopped against the retaining groove 486 at this time, prohibiting the first bar 30 from moving out of the engaged position P1. When the first bar 30 is in the released position P2, the two position limit portions 36;46 are disengaged from each other, allowing rotation of the spherical head 382 in the recessed accommodation chamber 48. At this time, the user can operate the first bar 30 to force the spherical head 382 against the inner wall 482 of the recessed accommodation chamber 48 and to further turn the second bar 40 relative to the first bar 30 (see FIG. 6), thereby rapidly fastening up the nut, or dismounting the loosened nut. Further, the rolling ball 70 is stopped against the inner wall 482 of the recessed accommodation chamber 48 at this time, assuring abutment of the spherical head 382 against the inner wall 482. However, it is to be noted that the wrench 20 can be configured without the elastic member 60 and the rolling ball 70.

When switching the first bar 30 between the engaged (locking) position P1 and the released (unlocking) position P2, the user can directly apply a downward or upward force to the first bar 30 relative to the second bar 40 at this moment to switch the relative relationship between the first bar 30 relative to the second bar 40. Thus, the wrench 20 allows the user to smoothly and rapidly switch the quick rotation function. Further, this design of wrench 20 has a simple structure, therefore it is easy to make and to assemble.

It is worth mentioning that, in the above-described preferred embodiment of the present invention, the first bar 30 carrying the rotary connector 38 works as a handle for holding by the user to operate the wrench 20; the second bar 40 carrying the recessed accommodation chamber 48 is adapted for turning bolts and nuts. However, in actual application, the first bar 30 and the second bar 40 can be exchanged.

Further, the first position limit portion 36 can be a recessed hole, and the second position limit portion 46 can be a block. Further, there is no limit to the shape of the first and second position limit portions 36;46, i.e., the first and second position limit portions 36;46 can be variously shaped to match each other and to have the first and second bars 30;40 be secured to each other. However, making the first and second position limit portions 36;46 in the shape of a regular polygon provides an indexing function, enabling the first and second bars 30;40 be selectively locked in one of multiple angular positions, for example, the wrench 20 can be configured for enabling the first and second bars 30;40 to be selectively locked at 60° angle or any of its multiples.

Further, the rotary connector 38 of the first bar 30 can be configured without the spherical head 382; the recessed accommodation chamber 48 of the second bar 40 can be not circular. Any alternate design that allows rotation of the rotary connector 38 in the recessed accommodation chamber 48 to stop against the inner wall 482 of the recessed accommodation chamber 48 and to further rotate the second bar 40 can be accepted.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A quick rotatable wrench, comprising:

a first bar comprising a first surface, a first position limit portion located at said first surface and a rotary connector extended from said first position limit portion;

a second bar comprising a second surface, a second position limit portion located at said second surface in a complementary shape to fit said first position limit portion, and a recessed accommodation chamber formed in said second position limit portion and adapted to accommodate said rotary connector for enabling said first bar to be movable relative to said second bar between an engaged position where said first position limit portion and said second position limit portion are engaged together to lock said first bar and said second bar together and a released position where said first position limit portion and said second position limit portion are disengaged from each other and said rotary connector is rotatable in said recessed accommodation chamber for allowing said first bar and said second bar to be moved relative to each other; and a position limit device mounted at said second bar to secure said rotary connector of said first bar to the inside of said recessed accommodation chamber of said second bar;

wherein when said first bar is in said released position, said rotary connector is stoppable against an inner wall of said recessed accommodation chamber to bias said second bar relative to said first bar, wherein said rotary connector of said first bar comprises a spherical head secured to the inside of said recessed accommodation chamber by said position limit device;

wherein said recessed accommodation chamber of said second bar is a circular blind hole so that said inner wall surrounds said spherical head.

2. The quick rotatable wrench as claimed in claim 1, wherein said spherical head of said first bar comprises a recessed hole, an elastic member mounted in said recessed hole and stopped against said spherical head, and a rolling ball supported between said elastic member and said inner wall of said second bar.

3. The quick rotatable wrench as claimed in claim 2, wherein said second bar further comprises a retaining groove formed in said inner wall and adapted for accommodating said rolling ball when said first bar is in said engaged position.

4. The quick rotatable wrench as claimed in claim 3, wherein said retaining groove extends around said spherical head.

5. The quick rotatable wrench as claimed in claim 1, wherein said first position limit portion of said first bar is a block member raised from said first surface; said second position limit portion of said second bar is a recessed hole formed in said second surface.

6. The quick rotatable wrench as claimed in claim 5, wherein the outer contour of said first position limit portion and the inner contour of said second position limit portion are regular hexagons.

* * * * *